United States Patent [19]

Parks

[11] Patent Number: 4,684,931

[45] Date of Patent: Aug. 4, 1987

[54] CAPACITIVE SENSING SECURITY SYSTEM

[76] Inventor: Sydney Parks, 6016 Gorrion NW., Albuquerque, N. Mex. 87120

[21] Appl. No.: 733,903

[22] Filed: May 14, 1985

[51] Int. Cl.[4] ..... G08B 13/26

[52] U.S. Cl. ..... 340/563; 340/562; 340/564; 340/514; 340/561; 340/510; 340/870.37

[58] Field of Search ..... 340/563, 562, 564, 514, 340/870.37, 561, 540, 510, 511; 324/60 R, 60 C

[56] References Cited

U.S. PATENT DOCUMENTS

| | | | |
|---|---|---|---|
| 3,778,807 | 12/1973 | Ralston | 340/564 |
| 3,836,828 | 9/1974 | Siegel | 340/563 |
| 4,063,447 | 12/1977 | Mathison | 340/563 |
| 4,295,132 | 10/1981 | Burney et al. | 340/562 |

*Primary Examiner*—Donnie L. Crosland
*Attorney, Agent, or Firm*—Harvey B. Jacobson

[57] ABSTRACT

Separate signal input circuits respond to intruder disturbances of a capacitive wire sensing grid to generate signal outputs processed to reject signals caused by environmental phenomena with a high degree of statistical probability, by comparison of individual signal outputs with an averaged signal output from all of the signal input circuits.

16 Claims, 8 Drawing Figures

VOLTAGE BRIDGE SECTION 22
BALANCED DETECTION SECTION 30
SYNCHRONOUS DETECTOR
LP FILTER
FAST TRACK PULSE GEN.
BAND PASS FILTER SECTION 32
COMPUTER
+12V
-12V
+4V

CAPACITIVE SENSING SECURITY SYSTEM

BACKGROUND OF THE INVENTION

This invention relates to security systems involving the use of intrusion defining sensor grids such as arrangements of capacitive sensing wires of a perimeter fence.

Fence wire security systems through which intrusion into a protected zone is detected are already known as well as the use of capacitance sensors. Such security systems will often unintentionally trigger alarms as a result of nonintruder or environmental phenomena such as lightning and other electromagnetic occurrences. Special and costly measures have therefore been taken to minimize false alarm triggering problems as well as to avoid signal errors that occur with greater frequency in security systems expanded to cover large protected zones with substantially long perimeter fences. Such security systems are often unable to indicate the exact location of detected intrusion.

It is therefore an important object of the present invention to provide a capacitive sensor-type of security grid capable of accommodating protected zones of varying size in a signal error-free manner.

Another important object is to provide the foregoing type of security system that is statistically more likely to avoid response to non-intruder disturbances in a less costly manner.

SUMMARY OF THE INVENTION

In accordance with the present invention, a protected zone is enclosed by a perimeter fence formed by an array of closly spaced grid line wires that act as capacitive sensors relative to a reference ground. Different pairs of such wires form inputs to a plurality of identical balanced bridge circuits that are excited by synchronized, low frequency, RF generators. Disturbance of a wire connected to a bridge circuit by an attempted intrusion unbalances the bridge circuit to produce an output signal that is fed through a signal processing system in which it is detected in phase relation to the reference output of the RF generator driving the bridge circuit. The detected signal is transmitted through a band pass filter section in which it is split between two frequency channels establishing a band pass limited to the expected signal frequencies associated with intruder disturbances. Channel separation is momentarily removed in response to alarm conditions to prevent unacceptable filter resetting delays. A signal output free of system errors such as those caused by capacitive drift is thereby fed to a signal processor from each of the bridge circuits.

The signal processing system averages all of the signal outputs for comparison with individual or groups of signal outputs through window comparators to provide signal data identifying intrusion by degree or amplitude and location. Further, intruder activity is determined from sensor-inputs with a high degree of statistical probability because the comparators act to reject residual common mode disturbances of all the sensors forming the grid line array of the perimeter fence. An automatic, self-testing capability is also provided for the signal processing system to verify its performance.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
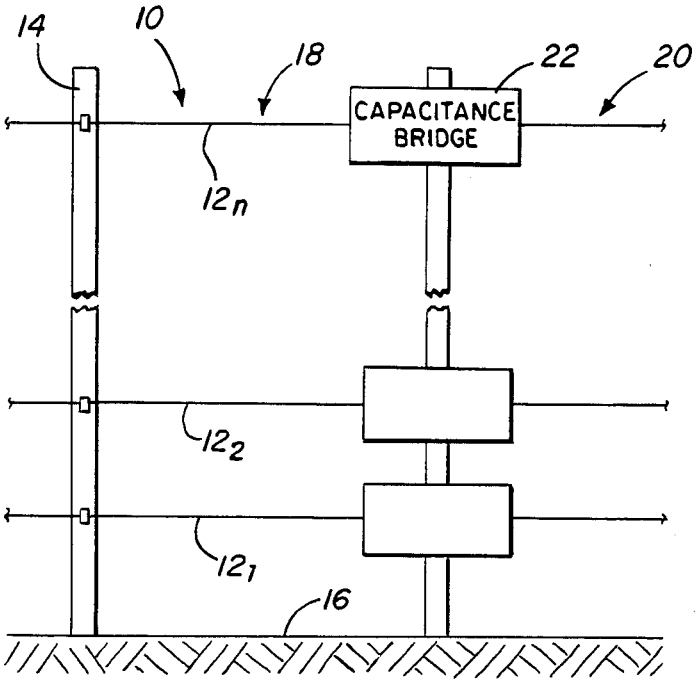
FIG. 1 is a simplified front elevational view of a portion of a perimeter fence associated with the security system of the present invention.
Figure 1A:
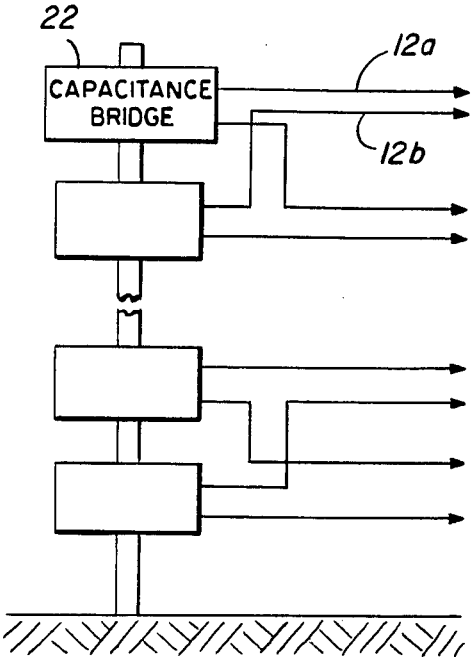
FIG. 1A is a simplified front elevational view showing an interlaced grid line array for the security fence in accordance with another embodiment.

Referring now to the drawings in details, FIG. 1 schematically illustrates a typical ground anchored security fence or grid installation in accordance with one embodiment of the present invention generally referred to by reference numeral 10. The fence 10 is formed by a plurality of parallel spaced, horizontal wires $\mathbf{12}_1$, $\mathbf{12}_2$, - - - $\mathbf{12}_n$ supported on vertical posts 14, such wires 12 constituting grid line sensors by virtue of their capacitive relationship to each other and to to the ground 16. Each of the sensor wires 12 is interrupted at an interface, between adjacent security zones 18 and 20, established by a plurality of identical, self-excited capacitance bridge sections 22. Thus, each interrupted grid line or fence wire forms a pair of capacitive sensor inputs to one of the bridge sections 22 in the grid shown in FIG. 1. Other intrusion defining grids are contemplated, including an interlaced array as shown in FIG. 1A wherein closely spaced pairs of sensor grid lines **12*a* and 12*b* are connected to the bridge sections 22. Only one grid line 12*a* of each pair forms a sensor input to one bridge section 22 while the other line 12*b* of the pair forms an input to an adjacent bridge section as shown. In both grids shown in FIGS. 1 and 1A, each bridge section 22** has two grid line sensor inputs.

Figure 2:
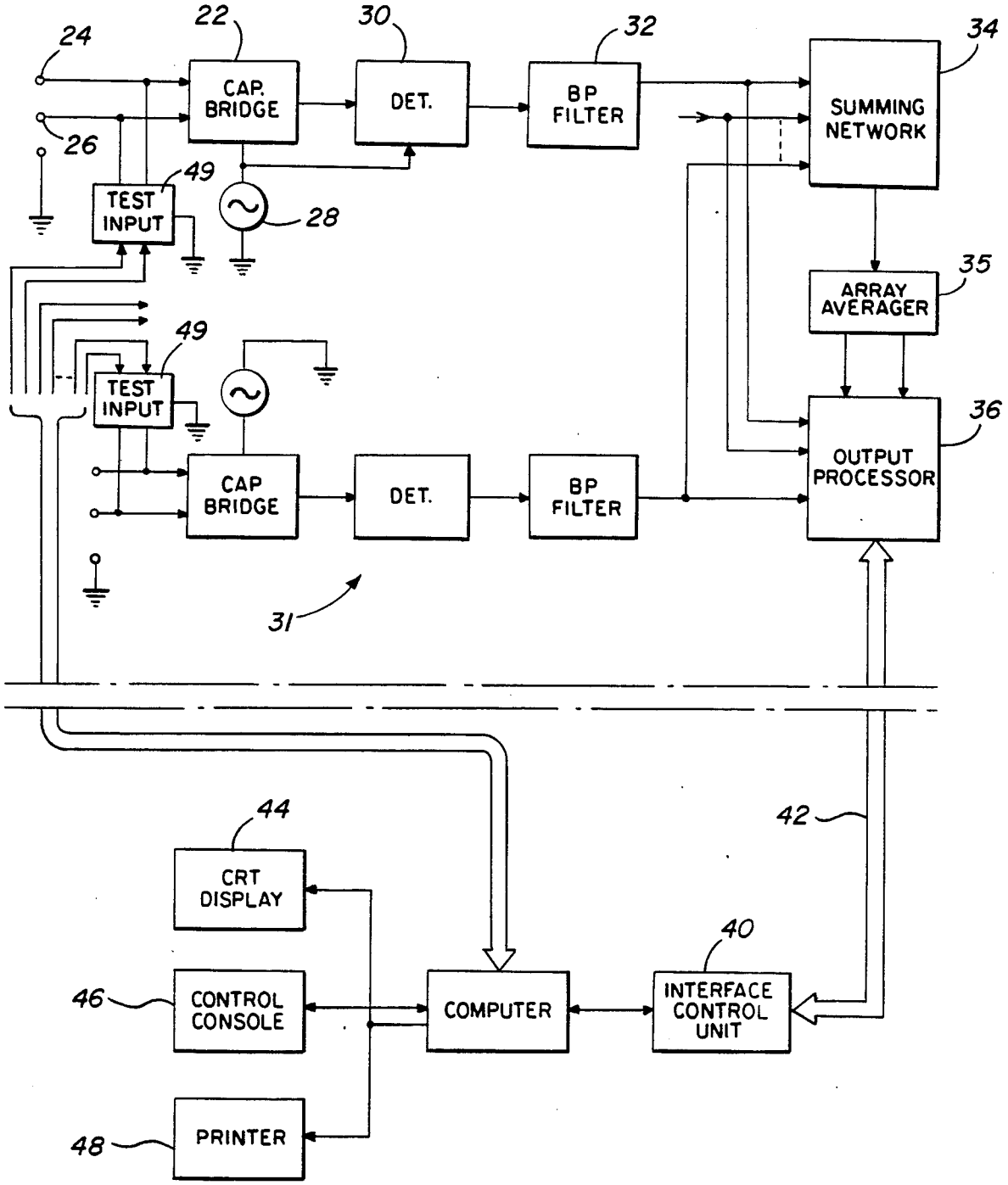
FIG. 2 is a block diagram illustrating the security system associated with the intrusion defining fence grids shown in FIG. 1 or 1A.

FIG. 2 depicts the security system associated with the grids wherein a plurality of the bridge sections 22 are respectively connected to different pairs of the sesors at input junctions 24 and 26 and to synchronized, low frequency, RF generators 28. Each bridge section is initially balanced so that a constant drive voltage from its generator 28 produces a zero output. When the bridge section is unbalanced by changes in capacitance between the input junctions and ground, an output is applied to a phase controlled detector section 30 of a signal processing system 31. The detector section 30 is driven by the same RF generator 28 as a reference signal source and its outputs will vary in amplitude and polarity to not only sense intrusion activity but to identify the nature of the intrusions. Toward that end, the signal output of each detector section 30 is transmitted through a band pass filter section 32 to reject signal errors caused by system drift and overload resetting delays. Error free signal voltages are applied from all of the filter sections 32 through a summing network 34 to an array averager 35 within which all of the signal voltages are averaged, and to an output processor 36 within which common mode disturbance signals are rejected to provide intrusion identifying outputs to an alarm processing computer 38 through an interface control unit 40.

With continued reference to FIG. 2, the interface control unit 40 functions to transmit the sensor data in the outputs 42 from the processor 36 in proper format to the computer 38 as well as to perform some limited computational functions allowing the system to remain operative at a degraded level. The computer 38, on the other hand, is designed to perform a fixed set of arithmetic functions on the incoming sensor data, monitor security system status and store status and maintenance history data. The output of the computer 38 is applied to a CRT display section 44 to exhibit alarm location information and to a control console 46 for display of status and control information. A control panel associated with the console 46 allows limited user interaction with the security system. A printer 48 is also made available to permanently record status and alarm information from the computer. A selftest routine is also initiated by the computer through test input sections 49 coupled to the input arms of the bridge sections.

Figure 3A:
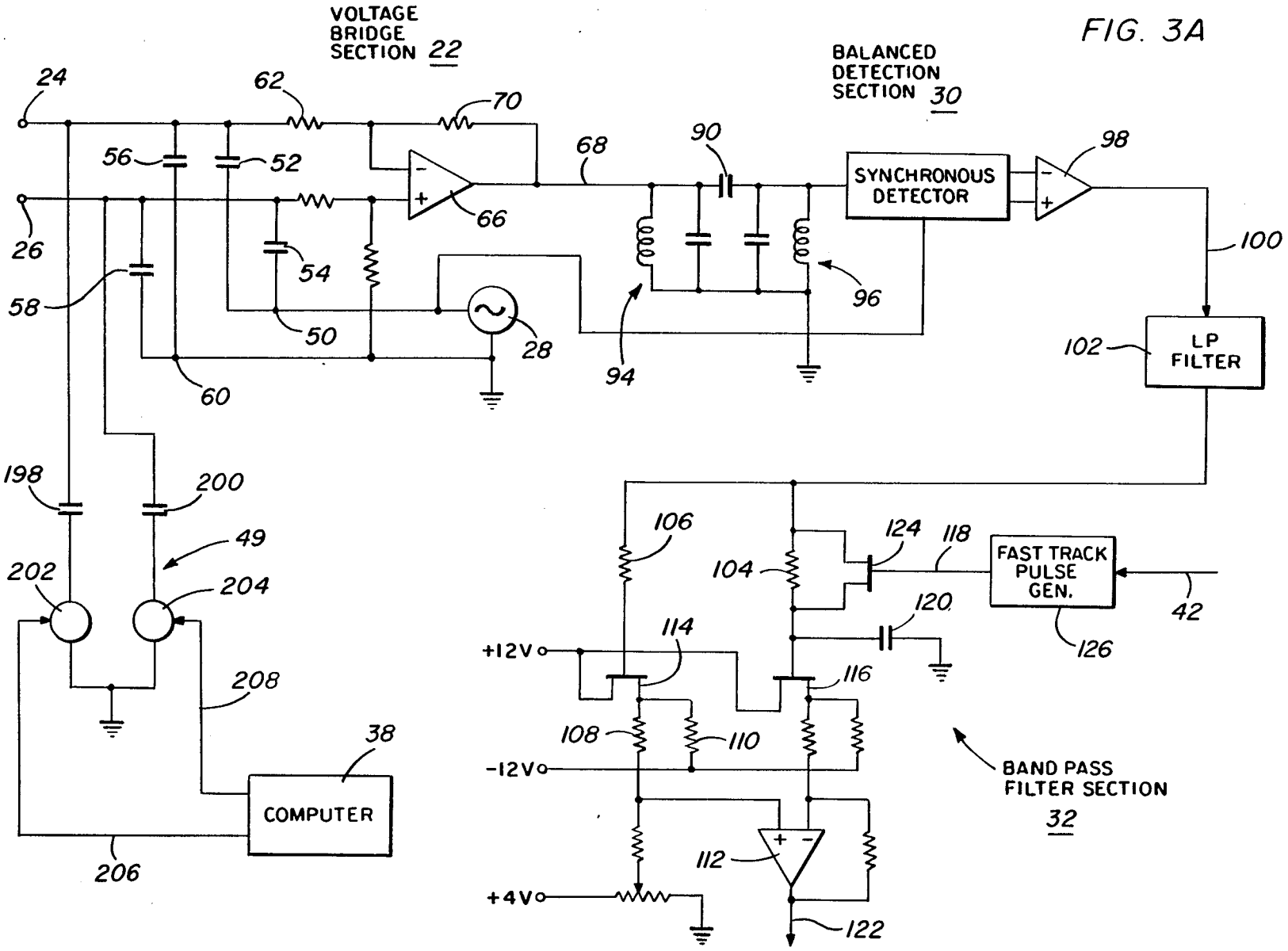
FIGS. 3A and 3B are electrical circuit diagrams illustrating the security system in greater detail.

In accordance with one embodiment of the invention as shown in FIG. 3A, each voltage bridge section 22 has its RF generator 28 supplying a constant, voltage to the junction 50 between two bridge arms formed by fixed impedance capacitors 52 and 54 respectively connected to the input bridge junctions 24 and 26. The input junctions may also be respectively connected to balancing capacitors 56 and 58 which are interconnected at a junction 60 to ground with the generator 28. Capacitors 56 and 58 are therefore paralleled by the capacitance between the input sensor lines and ground to form the other two bridge arms of variable capacitive impedances. The bridge input junctions 24 and 26 are coupled by resistors 62 and 64 to the inverting and non-inverting terminals of a differential amplifier 66. The output of amplifier 66, applied to output signal line 68, is coupled by feedback resistor 70 to the inverting input terminal. Any change in the balanced condition of the bridge section 22 caused by capacitive changes in the variable bridge arms paralleling capacitors 56 and 58 will produce a voltage difference at the input terminals of amplifier 66 to generate an output in line 68 either in phase or 180° out-of-phase with the RF generator signal. Thus, the signal amplitude and phase of the output in line 68 will identify any bridge unbalancing disturbance of the security grid or fence.

Figure 4:
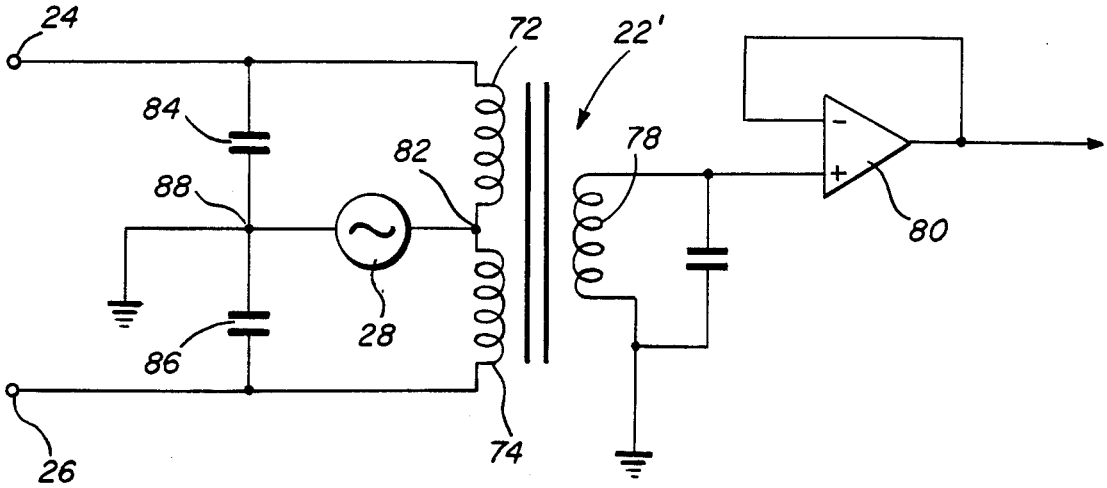
FIG. 4 is an electrical circuit diagram showing a modified form of balanced bridge circuit.

According to another embodiment as shown in FIG. 4, each pair of sensor wires is connected by input junctions 24 and 26 to a current driven type of bridge section 22', having series connected primary windings 72 and 74 of a transformer 76 connected across the input junctions. The secondary winding 78 of the transformer is connected to the non-inverting input terminal of a differential amplifier 40 from which the intrusion identifying output is obtained. The RF generator 28 is connected between ground and the center-tap junction 82 between primary windings 72 and 74 to apply a constant drive voltage to inductive arms of the bridge circuit. Capacitors 84 and 86 are connected between the ground junction 88 and the input junctions 24 and 26, respectively. In the balanced condition of the bridge circuit, equal currents in oppositely wound primary windings 72 and 74 produce a zero net flux and a zero voltage across the secondary winding 78. Capacitive unbalance of the bridge circuit, on the other hand, will be detected by an output from the differential amplifier 80.

Figure 3B:
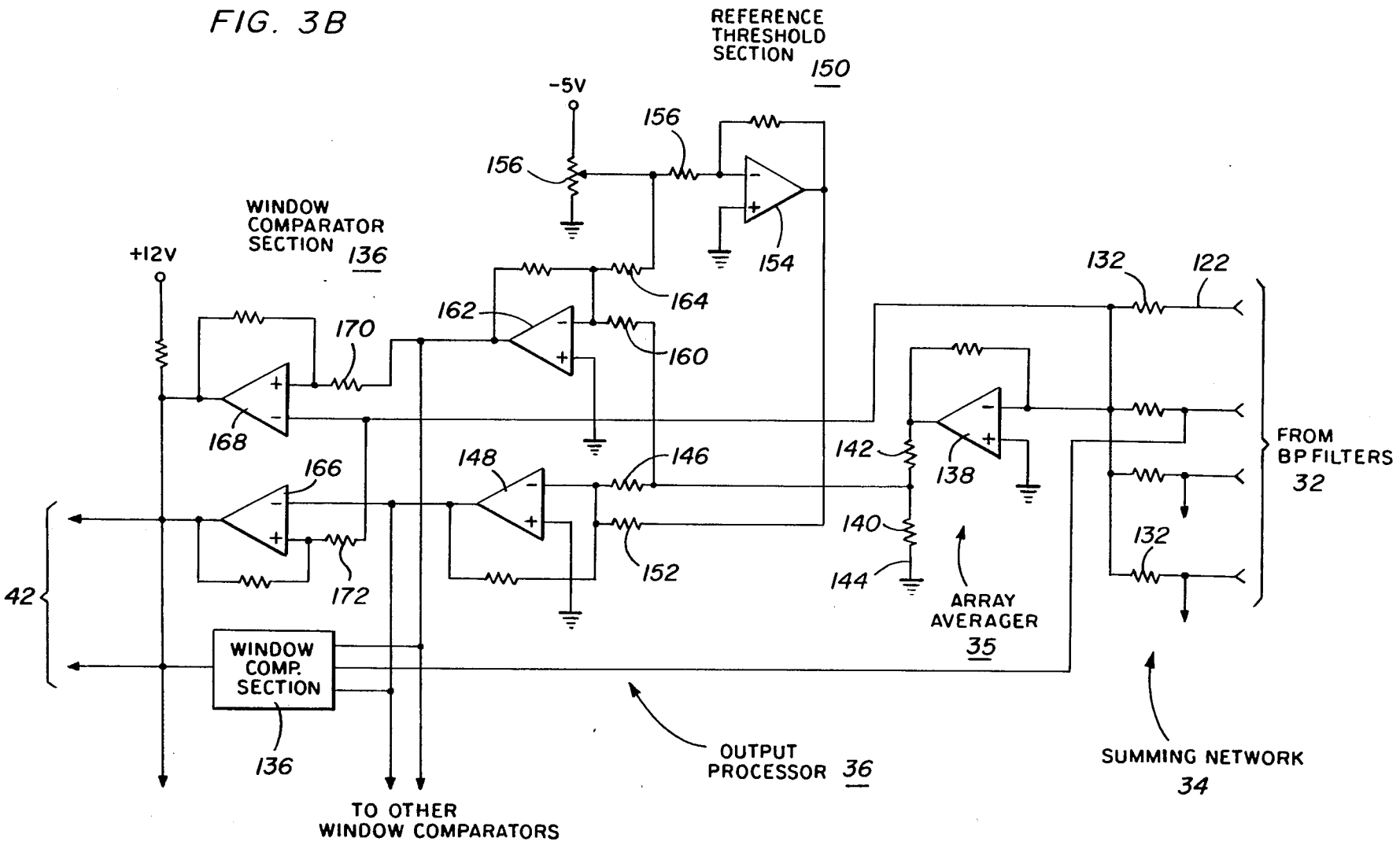

FIGS. 3A and 3B also illustrate in greater detail the signal processing system 31 for the bridge sections 22, including the detector section 30, the filter section 32, network 34, averager 35 and processor 36. The signal voltage in line 68 from each bridge section 22 is applied through a coupling capacitor 90 to a synchronous detector 92 of the balanced detector section 30. A reference voltage is applied by the RF generator 28 to the detector 92 which is in phase with the signal voltage received from capacitor 90 when the bridge section 22 is unbalanced in one direction. Such in-phase relationship is established by the band pass filter formed by grounded, parallel LC networks 94 and 96 on opposite sides of capacitor 90. When the bridge circuit is unbalanced in the other direction, then the input signal to detector 90 will be 180° out-of-phase with the reference voltage. A positive or negative output of detector 92 is applied through a differential amplifier 98 to signal line 100 to reflect bridge unbalance in terms of signal amplitude and polarity as a measure of the magnitude and nature of the fence disturbing intrusion.

The signal output in line 100 is fed to a conventional low pass filter 102 of the band pass filter section 32 to reject all signal voltages having frequencies above a cut-off frequency of 0.8 Hz. All signal voltages below such cut-off frequency of the low pass filter 102 are split into two frequency channels. The upper frequency channel is connected by resistor 106 to the control electrode of a field effect transistor 114 acting as a source follower. The lower frequency channel is connected by resistor 104 to the control electrode of a field effect transistor 116 acting as a source follower. The source followers 114 and 116 may be formed by a single dual FET chip. The outputs of the FET followers 114 and 116 are connected by resistors 108 and 110 to the non-inverting and inverting inputs of the differential amplifier 112. The resistor 104 in conjunction with grounded capacitor 120 forms a low pass filter with a cut-off frequency of 0.004 Hz. The output in line 122 from differential amplifier 112 is the difference between the lower and upper channel inputs between the 0.004 and 0.8 Hz cut-off frequencies. Such output frequency pass band of the differential amplifier 112 fed by line 122 to the output processor 36 is associated with intruder activity and the band-pass filtering action of filter section 32 will therefore reject slowly varying voltages associated with capacitive drift externally of the system. The resistor 104 is momentarily shunted by switch on of an overload limiting FET switch 124 whenever an alarm level signal is applied to the FET switch 124 through line 118 from a fast track pulse generator 126 activated by an intruder alarm output from processor 36 in line 42. Such switching action of FET 124 allows the grounded capacitor 120 connected to resistor 104 to rapidly charge to the low pass filter output voltage. In the absence of such resistor by-pass action of the FET switch 124, the system would be disabled for an unacceptably long period of time in view of the very long time constant associated with resistor 104 and capacitor 120.

The output voltage signals in lines 122 derived from each pair of sensor inputs to a bridge circuit is applied by an associated band pass filter section 32 to the output processor 36 through the summing network 34 as shown in FIG. 3B, which consists of a plurality of signal coupling resistors 132 connecting lines 122 in parallel to the signal averager 35. Each output line 122 is also connected to one of a plurality of window comparator sections 136 of the output processor 36 as shown in FIG. 3B. The signal voltages are applied in parallel from the resistors 132 to the inverting input of differential amplifier 138 in the signal averager to produce an output voltage proportional to the instantaneous average of all signal voltages received from the band pass filter sections 32. An averaged signal voltage is fed from the junction 140 between voltage dividing resistors 142 and 144 through a coupling resistor 146 to the inverting input of a differential amplifier 148 of a reference threshold generator section 150 of the output processor. Also fed to the inverting input of amplifier 148 in parallel with the averaged signal voltage is a fixed, positive DC voltage from coupling resistor 152 connected to the output of a reference voltage generating amplifier 154 of threshold section 150 having an inverting input connected by resistor 156 to a negative source of DC potential through adjustable resistor 158. Similarly, the averaged signal voltage from junction 140 is applied through resistor 160 to the inverting input of a second differential amplifier 162 in parallel with a fixed negative DC voltage from adjustable resistor 158 through resistor 164. Thus, two output voltages representing the averaged signal voltage, plus and minus a fixed DC voltage, are fed by differential amplifiers 148 and 162, respectively, to the inverting inputs of all differential amplifiers 166 and the non-inverting inputs of all differential amplifiers 168 in all of the window comparator sections 136 of the output processor through resistors 170. The individual outputs in lines 122 from band pass filter sections 32 are directly connected to the inverting input of amplifier 168 and through resistor 172 to the non-inverting input of amplifier 166 of one of the window comparator sections 136. The averaged center voltage outputs 42 of the window comparator sections 136 will therefore track the average output of all bridge sections 22 to reject any common signals reflecting residual common mode interfering phenomenon. Only individual or group voltages falling outside of the window comparator thresholds will produce one or more alarm triggering outputs.

FIG. 3A shows in greater detail the automatic, self-test arrangement formed by the test input sections 49 aforementioned in connection with FIG. 2 to verify performance of the signal processing system 31. The sensor input arms of each bridge section 22 are paralleled to ground by capacitors 198 and 200 when CMOS analog switches 202 and 204 are switched on under control of decoded digital commands in control lines 206 and 208 from the computer 38. The switches 202 and 204 thereby insert small fixed capacitances across one or the other of the input bridge arms at correct time intervals dictated by appropriate programming of computer 38. Insertion of such fixed test capacitance of capacitor 206 or 208 will unbalance the bridge circuit of section 22 in a test mode routine communicated to the computer from which the test commands in lines 206 and 208 originate.

Figure 6:
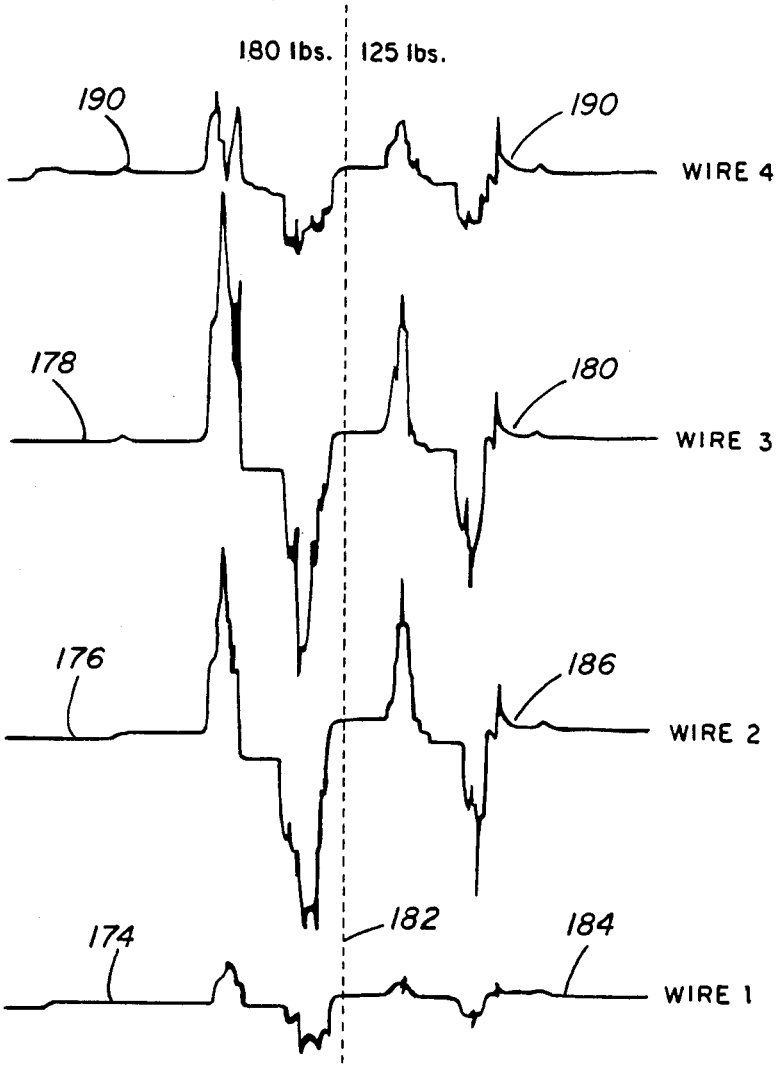
FIG. 6 is a graphical illustration of typical intrusion produced signal outputs associated with the system of the present invention.

By way of example, FIG. 6 graphically illustrate responses to intruder activity in terms of the separate analog outputs of the bridge sections 22 connected to four of the lower sensor wires 12 of an 8-wire security fence array as depicted in FIG. 1. The intruder activity involved is an attempt of two intruders to penetrate the fence grid at the same location between the second and third lowest wire causing deflection of such wires located 20 to 30 inches above ground. In the case of a 180 pound intruder output signal curves 174, 176, 178 and 180 to the left of vertical line 182 provide an intrusion signature exhibiting a close correlation in phase and shape with the signature curves 184, 186, 188 and 190 to the right of line 182 for a 125 pound intruder. Note also that the curves 176, 178 and 186, 188, corresponding to the wires deflected, have the peaks of greatest magnitude, while the peaks of curves 186 and 188 are somewhat less in magnitude than those of curves 176 and 178 reflecting a lighter weight intruder. Thus, the intrusion signatures of these curves indicate the intrusion identifying nature of the signal outputs of the bridge sections 22 from which the desired intrusion information may be extracted after being processed through the analog output processor 36 as hereinbefore described.

Figure 5:
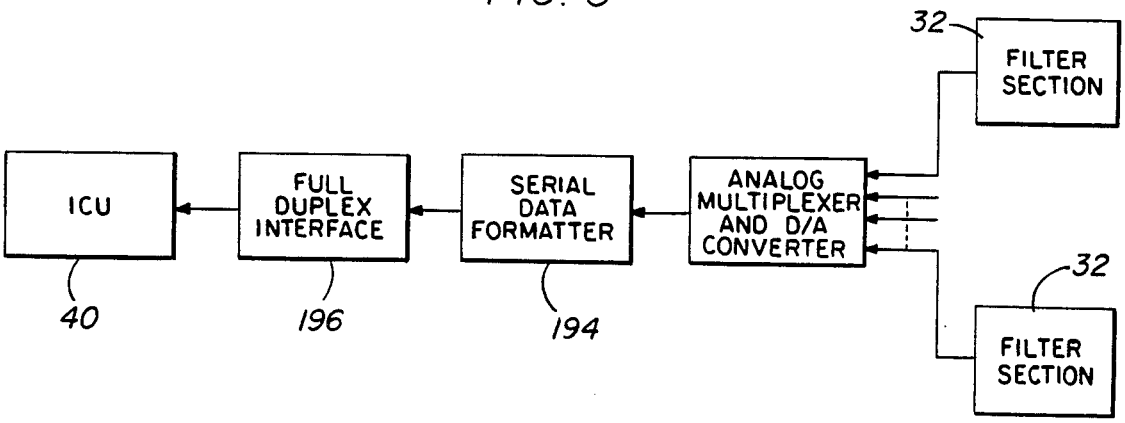
FIG. 5 is a block diagram showing a digital signal processing option for the security system depicted in FIG. 2.

The analog outputs of the band pass filter 32 may alternatively be digitized and statistically processed locally by a microprocessor, or serially formatted for transmission to a common computer at the interface control unit through a full duplex data link. In such case, the analog outputs from filter sections 32 as shown in FIG. 5 are fed through an analog multiplexer and an analog-to-digital converter combination 192 a serial data formatter 194, and a full duplex data link 196 to the unit 40.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a security system having a plurality of sensors arranged in an intrusion defining array, a plurality of separate signal input circuits respectively connected to at least two of the sensors, means connected to the input circuits for generating signals in response to uniform and localized disturbances of said sensors in the intrusion defining array, detector means connected to the signal generating means and the signal input circuits for producing a plurality of separate signal outputs that are directional functions of said disturbances and signal processing means operatively connected to the detector means for rejecting common mode signal components of the signal outputs caused by the uniform disturbances of the sensors to extract intrusion identifying data from the signal outputs.

2. The security system of claim 1 including filter means restrictively transmitting the signal output from the detector means to the signal processing means within a pass band rejecting errors created by external capacitive drift.

3. The security system of claim 2 wherein said filter means includes a pair of low pass filters, switching means operatively connected to said filters for establishing upper and lower frequency channels respectively having cut-off and low pass frequencies determined by said filters to define the pass band and overload limiting means connected to the switching means for momentarily disabling one of the low pass filters in response to excessive amplitude of the signal output passed by the other of the low pass filters.

4. The security system of claim 3 wherein said signal processing means includes a plurality of threshold signal generators and comparator means operatively connected to the threshold signal generators and the detector means for differentiating between the localized disturbances and the uniform disturbances of the intrusion defining array.

5. The security system of claim 4 wherein said signal generating means includes a plurality of reference signal sources connected to said signal input circuits and the detector means, said signal processing means further including signal averaging means for operatively connecting the detector means to the comparator means.

6. The security system of claim 1 wherein said signal processing means includes a plurality threshold signal generators and comparator means operatively connected to the threshold signal generators and the detector means for differentiating between the uniform and localized disturbances of the intrusion defining array.

7. In a security system having a plurality of sensors arranged in an intrusion defining array, a plurality of separate signal input circuits respectively connected to different pairs of the sensors and means connected to the signal input circuits for generating signals in response to uniform and localized disturbances of said sensors in the intrusion defining array, detector means connected to the signal generating means for producing separate signal outputs that are directional functions of said disturbances and signal processing means operatively connected to the detector means for differentiating between said functions of the uniform and localized disturbances to extract intrusion identifying data from the signal output.

8. The security system of claim 7 wherein said signal processing means includes a plurality of threshold signal generators, a plurality of comparators operatively connected to the threshold signal generators and the detector means, and signal averaging means operatively connecting the detector means to the comparators for rejecting said functions of the uniform disturbances in the signal outputs representing residual common mode interference with the intrusion defining array.

9. The security system as defined in claim 7 wherein each of the signal input circuits includes fixed impedance bridge arms connected to the signal generating means and variable impedance bridge arms connected to one of the pairs of the sensors.

10. The security system as defined in claim 9 including switch means connected to the variable impedance bridge arms for selectively inserting fixed impedance into the signal input circuits, and command control means connected to the switch means for activating the switch means to unbalance the circuits in a test mode.

11. The security system as defined in claim 7 wherein each of said signal input circuits includes a transformer having primary windings respectively connected to two of the sensors, a secondary winding and a junction interconnecting the primary windings in series, and an amplifier connecting the secondary winding to the detector means.

12. The system as defined in claim 11 wherein the signal generating means includes a reference signal source connected to the detection means and the junction between the primary windings of each of the signal input circuits.

13. The system as defined in claim 7 wherein the signal processing means includes means connected to the detector means for summing all of the signal outputs therefrom, array averager means connected to the summing means for producing an instantaneous output proportional to an average of said signal outputs and comparator means connected to the detector means and the array averager means for comparing individual signal outputs with the instantaneous averaged output of the array averager means.

14. The system as defined in claim 7 wherein the signal processing means includes an analog multiplexer connected to the detector means and means for digitizing said signal outputs.

15. In an intrusion detection system having a plurality of capacitive sensor elements exposed to the environment in which intrusion is to be detected, a plurality of signal circuits, means applying drive to each of said signal circuits for generating signals in response to disturbances of the environment of said sensor elements, detector means connected to the signal circuits and operating synchronously with said drive applying means for obtaining signal outputs from the detector means reflecting said disturbances of the environment of said sensor elements and signal processing means for rejecting common mode signal components, the improvement comprising array establishing means connecting different pairs of the sensor elements to each of the signal circuits for rendering the signal outputs of the detector means independent of each other prior to said rejection of the common mode signal components and intrusion indicating means connected to the detector means for receiving intrusion identifying data from the signal processing means free of the common mode signal components, said signal processing means including means connected to the detector means for averaging the independent signal outputs of the detector means and comparator means connected to the detector means and the averaging means for extracting the intrusion identifying data from the independent signal outputs by said rejection of the common mode signal components.

16. The improvement as defined in claim 15 wherein said intrusion identifying data originates from localized disturbances of the environment of the sensor elements while the common mode signal components originate from uniform disturbances caused environmentally.

* * * * *